US012628865B2

(12) United States Patent
Beghin et al.

(10) Patent No.: US 12,628,865 B2
(45) Date of Patent: May 19, 2026

(54) FILTER ELEMENT AND METHOD FOR MANUFACTURING THEREOF

(71) Applicant: Philip Morris Products S.A., Neuchatel (CH)

(72) Inventors: Alessandro Beghin, Bologna (IT); Nicolo Zuffa, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 739 days.

(21) Appl. No.: 16/487,496

(22) PCT Filed: Feb. 22, 2018

(86) PCT No.: PCT/EP2018/054422

§ 371 (c)(1),
(2) Date: Aug. 21, 2019

(87) PCT Pub. No.: WO2018/154006

PCT Pub. Date: Aug. 30, 2018

(65) Prior Publication Data

US 2020/0054067 A1 Feb. 20, 2020

(30) Foreign Application Priority Data

Feb. 27, 2017 (EP) ..... 17158177

(51) Int. Cl.
*A24D 3/02* (2006.01)
*A24D 3/17* (2020.01)

(52) U.S. Cl.
CPC ..... *A24D 3/0279* (2013.01); *A24D 3/17* (2020.01)

(58) Field of Classification Search
CPC ..... A24D 1/22; A24D 3/0225; A24D 3/0279; A24D 3/04; A24D 1/002; A24D 1/02;
(Continued)

(56) References Cited

U.S. PATENT DOCUMENTS 3,095,343 A * 6/1963 Berger ..... A24D 3/0233 28/283
3,847,064 A 11/1974 Berger
(Continued)

FOREIGN PATENT DOCUMENTS

CA 2 888 433 A1 6/2014
CN 104770874 A 7/2015
(Continued)

OTHER PUBLICATIONS

Combined Chinese Office Action and Search Report issued Jan. 28, 2021 in Chinese Patent Application No. 201880009646.2 (submitting English translation only), 8 pages.
(Continued)

*Primary Examiner* — Michael H. Wilson
*Assistant Examiner* — Stephanie Lynn Moore
(74) *Attorney, Agent, or Firm* — Oblon, McClelland, Maier & Neustadt, L.L.P.

(57) ABSTRACT

A filter element for an aerosol-generating article is provided, the filter element including a hollow tubular portion with an inner surface; and a flavourant deposited directly onto the inner surface of the hollow tubular portion. A forming device and a method for manufacturing a filter element for an aerosol-generating article are also provided.

5 Claims, 1 Drawing Sheet

(58) Field of Classification Search
CPC .... A24D 3/0216; A24D 3/0233; A24D 3/041; A24D 3/048; A24D 3/061; A24D 3/17
See application file for complete search history.

(56) References Cited

U.S. PATENT DOCUMENTS

| | | | | |
|---|---|---|---|---|
| 2013/0023395 | A1 | 1/2013 | Nakamura | |
| 2013/0140197 | A1 | 6/2013 | Fiebelkorn et al. | |
| 2014/0069447 | A1* | 3/2014 | Bailey | A24D 3/0275 131/331 |
| 2014/0299142 | A1* | 10/2014 | Dincer | A24D 3/041 131/329 |
| 2015/0027454 | A1* | 1/2015 | Li | A61M 11/003 131/328 |
| 2015/0313278 | A1 | 11/2015 | Brookbank et al. | |
| 2015/0359264 | A1* | 12/2015 | Fernando | H01J 49/0036 250/281 |
| 2016/0120216 | A1 | 5/2016 | Mironov et al. | |
| 2017/0042219 | A1* | 2/2017 | Delaloye | A24D 3/04 |
| 2018/0160726 | A1* | 6/2018 | Kadiric | A24D 3/04 |
| 2020/0054067 | A1* | 2/2020 | Beghin | A24D 3/17 |

FOREIGN PATENT DOCUMENTS

| | | | | |
|---|---|---|---|---|
| CN | 105072933 | A | 11/2015 | |
| DK | 2175749 | T3 | 8/2012 | |
| EP | 2 548 625 | A1 | 1/2013 | |
| EP | 2 554 060 | A1 | 2/2013 | |
| JP | 2007-520204 | A | 7/2007 | |
| JP | 2016-514473 | A | 5/2016 | |
| KR | 10-2015-0133736 | A | 11/2015 | |
| WO | WO 2011/114440 | A1 | 9/2011 | |
| WO | WO 2013/046401 | A1 | 4/2013 | |
| WO | WO-2014155340 | A1 * | 10/2014 | A24D 3/04 |
| WO | WO 2015/007556 | A1 | 1/2015 | |
| WO | WO-2016079469 | A1 * | 5/2016 | A24D 3/0279 |
| WO | WO-2017001613 | A1 * | 1/2017 | A24D 1/02 |

OTHER PUBLICATIONS

Japanese Office Action issued Jun. 24, 2021 in Japanese Patent Application No. 2019-546788 (submitting English translation only), 6 pages.
Korean Office Action issued Oct. 26, 2020 in Korean Patent Application No. 10-2019-7020336 (submitting English translation only), 3 pages.
Combined Decision to Grant and Russian Search Report issued Mar. 5, 2020 in Russian Patent Application No. 2019126807 (submitting English translation only), 7 pages.
Japanese Office Action issued Oct. 22, 2020 in Japanese Patent Application No. 2019-546788 (submitting English translation only), 5 pages.
International Search Report and Written Opinion issued May 22, 2018 in PCT/EP2018/054422 filed Feb. 22, 2018.
Third Party Observation issued Mar. 11, 2021 in European Patent Application No. 18708080.9, 9 pages.
Third Party Observation Issued Mar. 15, 2021 in European Patent Application No. 18708080.9, 3 pages.
European Office Action Issued Dec. 4, 2020 in European Patent Application No. 18708080.9, 2 pages.
Japanese Office Action issued May 9, 2022 in Japanese Patent Application No. 2019-546788 (with English translation), 9 pages.
Second Board Opinion dated Jan. 15, 2026, issued in corresponding Chinese patent application No. 201880009646.2 (with English translation) (citing document 2).
"Tobacco Science and Technology Discipline Development Report 2009-2010", China Association for Science and Technology, pp. 131-133, China Science and Technology Publishing House Apr. 2010.

* cited by examiner

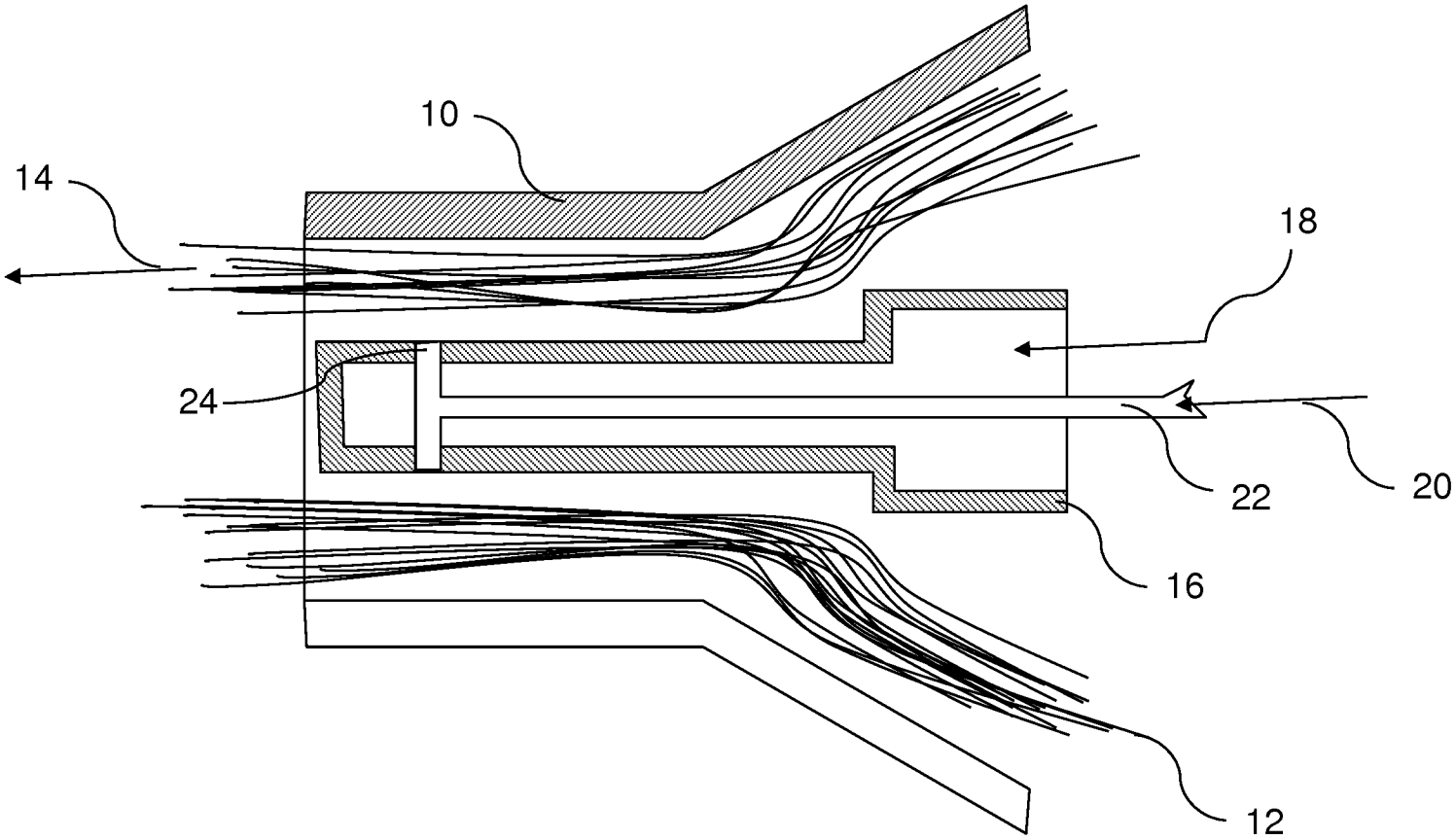
10
14
24
18
20
22
16
12

FILTER ELEMENT AND METHOD FOR MANUFACTURING THEREOF

The present invention relates to a filter element for an aerosol-generating article, the filter element comprising a hollow tubular portion with an inner surface. The present invention further relates to a forming device and a method for manufacturing a filter element for an aerosol-generating article.

It is known to modify the flavor of the aerosol of an aerosol-generating article by means of a flavourant. According to conventional solutions, flavourants can be provided in capsules within the filter of a smoking article. However, in such case, the flavor is released only when the user breaks the capsule.

Alternatively, flavourants can be provided on an inner liner of an aerosol-generating article.

For example, U.S. Pat. No. 3,062,218 A discloses a conventional cigarette. In this cigarette, shown in FIG. 2, a tobacco rod and a filter are provided. The filter is provided in a cylinder, wherein the inner surface of the cylinder can be coated with menthol to modify the flavor of the cigarette smoke.

Similarly, U.S. Pat. No. 9,220,298 B1 discloses a conventional cigarette with a paper wrapper surrounding tobacco and an open space adjacent to the tobacco. The inner surface of the paper wrapper can be coated with smoking flavor.

However, flavourants may impact on the stability of the product over time. For example, menthol may react with the usual glue used to bind components to the wrapping paper of a smoking article. Accordingly, spreading menthol flavor between the components and the wrapping material of the smoking articles may not be a favorable solution as it may create quality issues.

Another solution to have a continuous flavor is to provide the flavourant inside one of the rod components, for instance the filter of the smoking article. However, because the filter is made of randomly packed fibers, the air flow has a random path in the filter. To generate an identical experience from one smoking article to another, all the fibers of the filter should be uniformly provided with the flavourant. Furthermore, providing flavourant in the filter material could modify the resistance to draw (RTD) of the smoking article, which measures how strong a user has to draw onto the smoking article, and which is a critical parameter of the experience that should be accurately controlled.

It would be desirable to have an aerosol-generating article, in which the flavourant of the aerosol can be accurately and easily controlled.

According to a first aspect of the invention there is provided a filter element for an aerosol-generating article, the filter element comprising a hollow tubular portion with an inner surface. A flavourant is deposited directly onto the inner surface of the hollow tubular portion. The inner surface of the hollow tubular portion may be coated with the flavourant. Preferably, the flavourant impregnates the hollow tubular portion such that the hollow tubular portion is impregnated with the flavourant. The flavourant may thus be absorbed by the inner surface of the hollow tubular portion. Instead of the flavourant, an active agent may be used. Instead of the flavourant, a consumable agent may be used.

Preferably, the flavourant is only deposited onto the inner surface of the hollow tubular portion. In this way, the volume of the filter material in the filter element through which air can be drawn does not change. The resistance to draw consequently remains unchanged by the application of the flavourant. According to this aspect, the inner surface of the hollow tubular portion may be configured fluid- or liquid-impermeable such that the flavourant cannot penetrate into the filter material. The inner surface of the hollow tubular portion may be provided with an additional fluid- or liquid-impermeable layer. The inner surface of the hollow tubular portion may be heated or pressed to become fluid- or liquid-impermeable. The flavourant may also impregnate into the filter material. The flavourant may in this case still only impregnate the filter material to a degree that the resistance to draw does not or not substantially change. The flavourant may be soaked into the fibers of the filter material without obstructing air flow through interstices of the filter material. The volume of the filter element which is decisive for the resistance to draw is defined by the internal surface of the filter element seen in the cross-direction of the filter element as well as the length of the filter. The volume of the filter element available for defining the resistance to draw is consequently not negatively impaired by the flavourant.

Providing a hollow tubular portion in the filter element has the advantage that the air flow path inside such a hollow tubular portion is accurately known as the air (and aerosol) mainly travels in the hollow tubular portion. Thus, the quantity of flavor which is released into the aerosol may be adjusted by providing an appropriate amount of flavourant in the hollow tubular portion.

The hollow tubular portion may be aligned centrally within the filter element such that the filter element has a symmetric profile. Thus, the dimensional stability of the filter element may be enhanced.

Preferably, the flavourant is provided as a fluid. More preferably, the liquid is a liquid flavourant. Examples for flavourants are flavourants on alcohol base, glycol base or water base, essential oils, oleoresins, absolutes, plant concentrates, plant extracts, distillates and natural-artificial chemicals. Examples of flavourants that may be used are tobacco, bergamot, cinnamon, spearmint, peppermint, vanilla, orange, geranium extract, linalool, coffee, menthol, eucalyptus, clove, ginger and citrus. Generally, the flavourant may be provided as an aerosol modifying substance. The flavourant may be solid at room temperature. The flavourant may be a hot melt. The flavourant may be liquid at room temperature.

By depositing a flavourant onto the inner surface of the hollow tubular portion, the majority of the flavourant may be provided on the inner part of the hollow tubular portion. In this regard, the hollow tubular portion comprises an inner part facing radially inwards towards the inner hollow part of the hollow tubular portion, and an outer part facing radially outwards. The material of the hollow tubular portion may be chosen such that the flavourant, which is deposited onto the inner surface of the hollow tubular portion, essentially loads the inner part with flavourant. The outer part may remain essentially free from flavourant.

Generally, the production of filter rods starts from a filter material made of a mixture of various ingredients. The raw material for the manufacture of cigarette filters is commonly cellulose, for example obtained from wood. The cellulose is then acetylated, making it into a material called cellulose acetate or simply "acetate" for short, dissolved, and spun as continuous synthetic fibers arranged into a bundle called filter tow. This tow is generally opened, plasticized, shaped, and cut to length to act as a filter. The plasticizer dissolves the cellulose acetate fibers so that they stick together in a single unit by the action of pressure and heat so that the filter material solidifies and the filter rod is formed. Filters are commonly wrapped in a wrapping material, which in many cases includes a strip of paper.

Also, the production of filters which are non-wrapped in the wrapping paper is possible. In the production of non-wrapped filter plugs, the filter material is shaped in the desired form in a forming device. The material used and the process of shaping are so realized that the filter rod maintains its shape even after leaving the forming unit to a sufficient degree, so that the wrapping paper—otherwise used for shape stabilization—may be omitted. During the production of non-wrapped filter plugs, the filter material stream in the forming device may be subjected to pressure and heat. The necessary thermal energy may be introduced in various ways into the filter material, for example by hot-air, such as steam, or microwave energy, or by tampering.

Further, it is possible to produce hollow filters, that is, filters which include a hollow tubular portion passing through the filter along its longitudinal axis. Preferably, the filter is a hollow filter. Preferably, the filter is a hollow acetate tube.

Furthermore, the resistance to draw of the hollow tubular portion of the filter element, with or without a coating of flavourant on the inside surface, is preferably zero. The hollow tubular portion of the filter element preferably does not impact the global RTD of the aerosol-generating article.

As used herein, the term "rod" is used to denote a generally cylindrical element of substantially circular, oval or elliptical cross-section.

The filter material may comprise any suitable material or materials. Examples of suitable materials include, but are not limited to, cellulose acetate, cellulose, reconstituted cellulose, polylactic acid, polyvinyl alcohol, nylon, polyhydroxybutyrate, polypropylene, paper, thermoplastic material, such as starch, non-woven materials and combinations thereof. One or more of the materials may be formed into an open cell structure. Preferably, the filter material comprises cellulose acetate tow.

The filter material may include additional material. For example, the additional material may be incorporated into the filter tow. For example, the filter material may include a sorbent material. The term "sorbent" refers to an adsorbent, an absorbent, or a substance that may perform both of these functions. The filter material may include an adhesive or plasticizer or a combination thereof.

Preferably, the filter material includes a plasticizer. The plasticizer preferably has the function of a bonding constituent. Particularly in nonwrapped filters, as mentioned, the density or stiffness of the filter material needs to be higher than in standard wrapped filters due to the fact that there is no restraint action by the wrapping paper on the filter material. The filter material therefore, when formed in a rod-like shape, needs to keep a well-defined shape, with a substantially fixed diameter, without the aid of any additional external material.

A stiffer filter material may be needed due to the filter being hollow. In hollow filters, the hollow tubular portion may weaken the overall structure of the filter itself. In order to avoid deformations of the hollow tubular portion, for example by compression of the filter, it is preferred that the material from which the hollow filter is realized is stiffer than the material from which a standard filter plug is formed.

Filters realized with the invention may advantageously be used in aerosol-forming articles. Aerosol forming articles according to the present invention may be in the form of filter cigarettes or other smoking articles in which tobacco material is combusted to form smoke. The present invention additionally encompasses articles in which tobacco material is heated to form an aerosol, rather than combusted, and articles in which a nicotine-containing aerosol is generated from a tobacco material, tobacco extract, or other nicotine source, without combustion or heating. These articles in which aerosol is formed without combustion or where smoke is produced by combustion are in general called "aerosol-forming articles". Aerosol forming articles may be whole, assembled aerosol forming articles or components of aerosol forming articles that are combined with one or more other components in order to provide an assembled article for producing an aerosol, such as for example, the consumable part of a heated smoking device.

An aerosol forming article may be an article that generates an aerosol that is directly inhalable into a user's lungs through the user's mouth. An aerosol forming article may resemble a conventional smoking article, such as a cigarette and may comprise tobacco. An aerosol forming article may be disposable. An aerosol forming article may alternatively be partially-reusable and comprise a replenisheable or replaceable aerosol forming substrate.

In order to shape the filter material, which preferably includes a plasticizer, into a continuous rod further used for the production of filters, a forming device is provided. The forming device comprises a tubular element which may be charged with filter material. The forming device further comprises a rod-shaped element with a nozzle for discharging flavourant. The rod-shaped element is at least partly arranged inside the tubular element. The nozzle is arranged at the outer surface of the rod-shaped element for discharging a flavourant.

Filter material from a source such as a filter tow bundle is advanced towards the forming device. Consequently, an inlet of the forming device is connected to a terminating end of the feed path of the filter material. The forming device is adapted to form the filter material into a rod-shaped continuous filter body and with an outlet to deliver the formed continuous filter body for further processing. The forming device comprises a tubular element adapted to allow the filter material to pass therethrough to form the filter material into the continuous filter body. The tubular element may be funnel-shaped at the inlet to facilitate the insertion of the filter material. The inner walls of the tubular element preferably define the outer surface of the continuous filter body and preferably determine, among others, its diameter. The inner walls of the tubular element "compress" the filter material into a rod. Further, in order to render the filter material stiff and with a substantially constant shape, a heat source adapted to heat the filter material passing in the tubular element may also be provided, so that the possibly present bonding material, such as the plasticizer possibly present within the filter material, provides for the bonding among the fibers of the filter material. Plasticizers are additives that increase the plasticity or fluidity of a material.

The heat source could be for example a microwave source, an infrared source, or a steam source such as water steam. The steam source may have a temperature of more than about 120 degrees Celsius, for example of more than about 200 degrees Celsius. The selection of the source depends on the type of plasticizer and on the way in which the plasticizer may be activated. Preferably, the filter material is heated at a temperature of at least about 30 degrees Celsius, preferably of at least about 35 degrees Celsius, preferably of at least about 40 degrees Celsius.

For forming the hollow tubular portion in the filter rod, the forming device comprises a rod-shaped element. The rod-shaped element is at least partly arranged inside the tubular element, so that the outer walls of the rod-shaped element preferably define the inner surface of the continuous filter body, i.e. the inner surface of the hollow tubular portion of the filter rod. Thus, the outer walls of the rod-shaped element determine the diameter of the hollow tubular portion in the filter rod. The outer walls of the rod-shaped element "compress" the filter material into a rod. The rod-shaped element is provided inside the tubular element such that the filter material is compressed or sandwiched between the inner walls of the tubular element and the outer walls of the rod-shaped element.

The rod-shaped element may comprise a heating element for heating the rod-shaped element. By heating the rod-shaped element, the filter material may be rendered stiff and with a substantially constant shape as described with reference to the heating element of the tubular element. The heating element is provided so that the possibly present bonding material, such as the plasticizer possibly present within the filter material, provides for the bonding among the fibers of the filter material. The heating element in the rod-shaped element may be provided instead or additional to the heating element in the tubular element. The heating element in the rod-shaped element may heat the hollow filter rod originating from the inner surface of the hollow tubular portion of the filter rod. The heating element in the tubular element, on the other hand, may heat the hollow filter rod originating from the outside of the filter rod. Beneficially, both the rod-shaped element as well as the tubular element comprise heating elements to uniformly heat the hollow filter rod.

Preferably, the rod-shaped element is hollow such that the rod-shaped element may be heated by circulating hot steam within the rod-shaped element. A microwave source, infrared source or resistive element may be provided in the rod-shaped element. The steam may have a temperature of more than about 120 degrees Celsius, for example of more than about 200 degrees Celsius. The selection of the source depends on the type of plasticizer and on the way in which the plasticizer may be activated. Preferably, the filter material is heated at a temperature of at least about 30 degrees Celsius, preferably of at least about 35 degrees Celsius, preferably of at least about 40 degrees Celsius.

The rod-shaped element comprises a nozzle for discharging flavourant. The flavourant preferably is a liquid flavourant as described in detail above. The nozzle is preferably provided on the outer surface of the rod-shaped element such that the flavourant may be discharged radially outwards from the rod-shaped element. By discharging flavourant from the rod-shaped element, flavourant is deposited on the inner surface of the hollow tubular portion of the filter rod. In other words, a hollow filter rod, preferably a hollow acetate filter rod, is provided with a coating of flavourant on the inside of the filter rod at the surface of the hollow tubular portion of the filter rod. In that way, the flavor of an aerosol which is drawn through the filter may be precisely adjusted, since the aerosol is predominantly drawn through the filter through the coated hollow tubular portion of the filter rod.

The nozzle may comprise a plurality of nozzles such that the flavourant is discharged uniformly from the rod-shaped element. There may be one nozzle or two nozzles or more than two nozzles. The nozzle may be configured as a longitudinal slit or as small holes with an essentially circular shape. The nozzle or the rod-shaped element may be rotatable such that a uniform discharging of flavourant may be facilitated. Multiple nozzles may be distributed uniformly around the outer circumference of the rod-shaped element. The multiple nozzles may have a ring-shaped configuration around the outer circumference of the rod-shaped element.

The nozzle may comprise a feed pipe within the rod-shaped element for feeding flavourant to the nozzle. In that way, a smooth outer surface of the rod-shaped element may be provided such that a smooth inner surface of the hollow tubular portion of the filter rod may be created. There is further provided a method for manufacturing a filter element for an aerosol-generating article. The method comprises the steps of providing a hollow tubular portion with an inner surface in a filter element, and depositing a flavourant onto the inner surface of the hollow tubular portion of the filter element.

The method may further comprise the steps of charging a forming device with filter material for forming the filter element, providing a rod-shaped element in the forming device, wherein the rod-shaped element comprises a nozzle for discharging flavourant, positioning the rod-shaped element in the forming device such that a hollow tubular portion is formed in the extruded filter material, and discharging flavourant from the nozzle of the rod-shaped element such that flavourant is deposited onto the inner surface of the hollow tubular portion of the extruded filter material.

The term "extruded" comprises products made with processes in which a material is pushed through a die of a desired cross-section. Also, products are encompassed by this term which are produced by different processes such as drawing the respective material.

Furthermore, the method may comprise that the rod-shaped element comprises a heating element for heating the rod-shaped element, and wherein, in a further step, the rod-shaped element is heated to bond the extruded filter material for forming the hollow tubular portion in the extruded filter material.

The invention will be further described, by way of example only, with reference to the accompanying drawings in which:

FIG. 1 shows a cross-sectional view of an inventive forming device for manufacturing a filter element for an aerosol-generating article.

The forming device shown in FIG. 1 comprises a tubular element 10. The tubular element 10 is configured as a funnel-shaped element at the inlet side. The tubular element 10 is shaped so that filter material 12 can be introduced into the tubular element 10.

The filter material 12 is advanced through the tubular element 10 by conventional means along the direction of the arrow 14, i.e. towards an outlet of the tubular element 10. In that way, a continuous filter rod is created. The forming device may comprise a heating element to heat the filter material 12 while the filter material 12 is advanced through the tubular element 10 such that a bonding agent within the filter material 12 reacts and the filter material 12 is bonded. By bonding the filter material 12, the shape of the finished filter rod is defined.

The filter rod which is created with the invention is a hollow acetate tube. Consequently, the filter material is cellulose acetate. For creating a hollow tubular portion within the filter rod, a rod-shaped element 16 is arranged inside the tubular element 10. The rod-shaped element 16 has a cylindrical outer shape such that the outer shape of the rod-shaped element 16 defines the inner diameter of the hollow tubular portion of the filter rod. In other words, the diameter of the rod-shaped element 16 defines the diameter of the hollow tubular portion of the finished filter rod.

The rod-shaped element 16 is provided with a hollow portion 18 such that heated steam can be circulated within the rod-shaped element 16. The rod-shaped element 16 is—apart from the entrance area for hot steam indicated by reference numeral 18—closed such that the hot steam cannot directly contact the filter material 12. By circulating hot steam within the rod-shaped element 16, the rod-shaped element 16 can be heated to facilitate a bonding of the surrounding filter material 12 while the filter material 12 is advanced through the tubular element 10.

Additionally, a flavourant 20 is advanced through the rod-shaped element 16 by means of a feed pipe 22 towards a nozzle 24. The flavourant 20 is discharged or sprayed onto the surrounding filter material 12 while the filter material 12 is advanced through the tubular element 10. The flavourant 20 is provided as a liquid flavourant. Consequently, a coating of flavourant 20 is provided on the inner surface of the hollow tubular portion of the filter material 12. In the end, the finished filter rod is provided as a hollow acetate tube with a coating composed of the flavourant. After that, the filter rod can be further processed, for example by cutting the continuous filter rod into smaller filter segments.

The invention claimed is:

1. An aerosol-generating article comprising a filter element, the filter element comprising:

a hollow tubular portion with an inner surface;

a flavourant deposited directly onto the inner surface of the hollow tubular portion, the flavourant being configured to release flavor into an aerosol generated by the aerosol-generating article without combustion, wherein the inner surface of the hollow tubular portion is a heated or a pressed fluid-impermeable or liquid-impermeable inner surface such that the flavourant cannot penetrate into a filter material of the filter element, wherein the flavourant is deposited onto the inner surface of the hollow tubular portion such that a volume of filter element material through which air can be drawn remains unchanged from before the deposition to after the deposition, wherein a resistance to draw of the filter element remains unchanged by the deposition of the flavourant and by the hollow tubular portion, and wherein the filter element is a hollow filter and includes an airflow path inside the hollow filter in the hollow tubular portion; and a tobacco rod in contact with and upstream of the hollow tubular portion opposite to an outlet of the hollow tubular portion.

2. The aerosol-generating article according to claim 1, wherein the flavourant is menthol.

3. The aerosol-generating article according to claim 1, wherein the filter element is a hollow acetate tube.

4. The aerosol-generating article according to claim 1, wherein the hollow tubular portion is provided in the filter element as a central hollow tubular portion and/or wherein the hollow tubular portion of the filter element is provided to form the airflow path for an aerosol.

5. The aerosol-generating article according to claim 1, wherein the filter material of the filter element comprises cellulose acetate fibers.

* * * * *